166-274 SR
2/10/81 OR 4,249,607

United States Patent [19]

Allen

[11] 4,249,607

[45] Feb. 10, 1981

[54] MISCIBLE DISPLACEMENT OIL RECOVERY METHOD

[75] Inventor: Joseph C. Allen, Bellaire, Tex.

[73] Assignee: Texaco Inc., White Plains, N.Y.

[21] Appl. No.: 39,726

[22] Filed: May 17, 1979

[51] Int. Cl.[3] ..... E21B 43/22; E21B 36/00

[52] U.S. Cl. ..... 166/274; 166/302

[58] Field of Search ..... 166/273, 274, 302, 305 R

[56] References Cited

U.S. PATENT DOCUMENTS

| | | | |
|---|---|---|---|
| 2,259,428 | 10/1941 | Shelley | 166/302 |
| 3,135,326 | 6/1964 | Santee | 166/273 X |
| 3,439,743 | 4/1969 | Wyllie | 166/273 X |
| 3,841,403 | 10/1974 | Burnett et al. | 166/274 |
| 3,850,243 | 11/1974 | Allen et al. | 166/274 X |
| 3,850,245 | 11/1974 | Allen et al. | 166/274 |
| 3,856,086 | 12/1974 | Braden, Jr. | 166/274 |
| 3,989,108 | 11/1976 | Allen | 166/302 |
| 4,003,432 | 1/1977 | Paull et al. | 166/302 X |

*Primary Examiner*—James A. Leppink
*Assistant Examiner*—George A. Suchfield
*Attorney, Agent, or Firm*—Carl G. Ries; Robert A. Kulason; Jack H. Park

[57] ABSTRACT

An improved miscible displacement oil recovery process, and particularly a vertical downward gas driven miscible blanket oil recovery process is disclosed. Reduction of temperature in the portion of the reservoir where miscible displacement is occurring reduces the pressure required to attain miscibility with a specified solvent-dry gas injection mixture; or at constant pressure, reduces the amount of solvent required to be injected to achieve a condition of miscibility. Cooling is achieved by chilling the solvent prior to injecting it into the reservoir, or cooling the high pressure dry gas injected into the reservoir, or both.

16 Claims, 2 Drawing Figures

MISCIBLE DISPLACEMENT OIL RECOVERY METHOD

FIELD OF THE INVENTION

This invention pertains to a miscible flooding oil recovery process and particularly to an improved oil recovery process utilizing a vertical, downward moving, miscible blanket in which the pressure required in the reservoir to attain miscibility is reduced.

BACKGROUND OF THE INVENTION

Petroleum is found in subterranean formations or reservoirs in which it has accumulated, and recovery is initially accomplished by pumping or permitting the petroleum to flow to the surface of the earth through wells drilled into the subterranean formation for that purpose. Petroleum can be recovered from subterranean formations only if certain conditions are satisfied. For example, there must be an adequately high concentration of petroleum in the formation, and there must be sufficient porosity and permeability or interconnected flow channels throughout the formation to permit the flow of fluids therethrough if sufficient pressure is applied to the fluids. Furthermore, the formation petroleum viscosity must be sufficiently low that petroleum will flow through the flow channels if pressure is applied thereto. When the subterranean petroleum-containing formation has natural energy present in the form of an underlying active water drive, or solution gas, or a high pressure gas cap above the petroleum-saturated zone, this natural energy is utilized to recover petroleum. This phase of oil recovery is referred to as primary recovery. When this natural energy source is depleted, or in the instance of those formations which do not originally contain sufficient natural energy to support primary recovery operations, some form of enhanced recovery or supplemental recovery process must be applied to the formation. Supplemental oil recovery is sometimes referred to in the literature as secondary or tertiary recovery, although in fact it may be primary, secondary or tertiary in sequence of employment.

Although waterflooding or water injection is the simplest and most widely used form of oil recovery, it is only partially effective because water does not displace petroleum efficiently. Persons skilled in the art of oil recovery have recognized this inefficiency of waterflooding, and it has been proposed in the literature to inject a solvent for petroleum into the formation to reduce the viscosity of the naturally occurring petroleum, followed by injecting a drive fluid, such as water or natural gas, in order to recover a higher percentage of the formation petroleum than is possible utilizing water or gas alone.

A particularly promising type of miscible flooding which has been applied successfully to reservoirs having substantial vertical thickness, is referred to as vertically downward moving, miscible blanket flooding. This type of oil recovery is especially suitable for use in thick reservoirs, e.g., petroleum reservoirs having vertical thickness in excess of 50 feet or more. In miscible blanket flooding, a solvent, e.g., a material which is miscible under reservoir conditions with formation petroleum, is injected into the upper portion of the petroleum reservoir. After a predetermined volume of solvent is injected, sufficient to form a thin layer or blanket on the top of the oil-saturated portion of the formation, a drive fluid such as lean or dry gas, e.g., natural gas or methane, is injected into the upper portion of the formation in order to displace the slug or blanket of solvent vertically downward. The idealized version of downward miscible blanket flooding contemplates the establishment of a discrete, relatively thin layer of solvent which is spread completely across the top of the petroleum formation, with the layer of solvent then being displaced downward in a substantially piston-like manner by the subsequently-injected dry gas. Oil production is ordinarily taken from wells completed in and in fluid communication with the bottom of the petroleum-containing formation. Drive gas will displace liquid solvent and petroleum efficiently only if it is displacing the solvent and petroleum vertically downward, thereby employing gravitational forces to stabilize the process and avoiding viscous fingering as is sometimes encountered when gas injection is applied to a formation in a horizontally moving displacement process.

Although in this simplified description, the solvent action is obtained from the intermediate ($C_2$–$C_9$) hydrocarbon components injected for the purpose of functioning as a solvent, and the gas is described only as an inert displacing agent, in fact a multicomponent mixture is formed in the formation, comprising the heavy components, e.g., the hydrocarbon or petroleum naturally occurring in the formation, the intermediate component hydrocarbon species which is the liquid solvent injected into the formation, and the drive gas which may be considered to be essentially pure methane. Since methane is substantially less expensive than the intermediate component hydrocarbon, e.g., LPG or liquified petroleum gas or other hydrocarbons which may be injected for the purpose of functioning as a solvent or miscible displacement agent for petroleum, it is highly desirable to operate under conditions where miscibility is achieved between components of the naturally-occurring petroleum, the injected solvents, and the injected drive gas, utilizing the smallest volume possible of solvent. To accomplish this, it is frequently necessary to raise the pressure existing in the formation where it is desired to obtain a condition of miscibility.

In field application of the above process, considerable difficulty has often been encountered in obtaining sufficient increase in formation pressure to achieve the desired condition of miscibility. This sometimes results from inherent low pressure in the reservoir, or the presence of a high gas saturation of the oil zone, the presence of a substantial size gas cap, or the presence of a low pressure aquifer below the petroleum-saturated interval which is of much greater size than the petroleum formation. When these conditions are encountered, injection of substantial quantities of gas, even at maximum injection rates, raising the pressure of the reservoir sufficiently to achieve miscibility between oil and the injected miscible fluids can seldom be accomplished. Accordingly, there is a substantial problem in applying the miscible oil recovery method described above to subterranean petroleum-containing formations because of the inability to raise the formation pressure substantially to attain miscibility with the injected miscible displacing fluids.

DESCRIPTION OF THE PRIOR ART

U.S. Pat. No. 3,850,243 describes a vertically downward moving, miscible blanket oil recovery method in which a dense solvent is co-mixed with the injected solvent to increase the spreading rate of the solvent bank across the oil column.

U.S. Pat. No. 3,993,555 discloses a method for separating bitumen from tar sand material by contacting the material with a solvent at a temperature below the freezing point of water in order to accomplish separation of hydrocarbon and sand minerals without forming a froth with water present in the tar sand material.

U.S. Pat. No. 4,003,432 issued Jan. 18, 1977, describes a method of separating bitumen from tar sand formations employing a solvent having a freezing point substantially lower than the freezing point of water, said solvent being cooled to a temperature substantially below the freezing point of water prior to injecting into the formation, in order to displace hydrocarbons without displacing water into the formation.

U.S. Pat. No. 3,924,682 issued Dec. 9, 1975, describes a method of cooling a subterranean formation by injecting cold water to permit use of a temperature-sensitive surfactant in a high temperature formation.

U.S. Pat. No. 4,050,513 issued Sept. 27, 1977, describes a method of injecting cold water to cool a subterranean formation prior to injecting a solution of a temperature-sensitive hydrophilic polymer.

SUMMARY OF THE INVENTION

Disclosed is an improved miscible oil recovery process, especially a gas driven, vertically downward moving miscible blanket oil recovery method in which the pressure required to attain miscibility between the injected solvent and the formation petroleum is reduced by reducing the temperature in the portion of the formation contacted by the injected solvent. The amount of hydrocarbon required to be utilized in achieving miscibility may also be reduced by this method. The temperature reduction may be accomplished by cooling the solvent to a temperature substantially less than the reservoir temperature prior to injecting it into the formation, or by cooling the drive gas prior to injecting it, or by both means.

DESCRIPTION OF THE PREFERRED EMBODIMENTS

Figure 1:
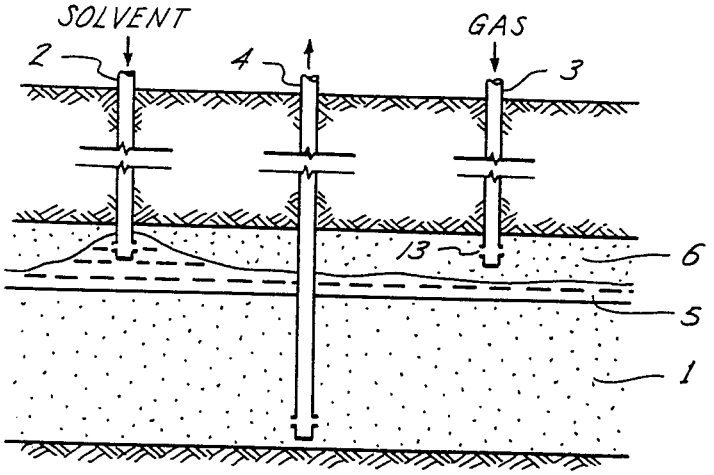
FIG. 1 illustrates a cross sectional view of a formation in which a vertically downward miscible blanket flooding oil recovery process employing the improvement of this invention is being applied.

Basically, my invention is concerned with an improvement in miscible flooding oil recovery technology. The preferred form of miscible displacement to which the process of my invention may be applied is a gas driven, vertically downward-moving miscible blanket oil recovery process. The vertically downward-moving gas driven miscible blanket oil recovery process may best be understood by referring to FIG. 1, in which formation 1 is penetrated by solvent injection well 2 which is in fluid communication with the upper portion of formation 1, and by gas injection well 3 which is also in fluid communicaton with the upper portion of formation 1, and by production well 4 which is in fluid communication of the bottom of oil formation 1. In conventional practice, a solvent, usually an intermediate $C_2$ to $C_9$ and preferably $C_3$ to $C_5$ hydrocarbon, ordinarily a mixture of hydrocarbons within this range, such as commercially available mixtures including LPG or liquified petroleum gas, is injected into the upper portion of the formation via well 2. The liquid solvent spreads across the upper portion of the formation, since the solvent density is less than the density of the petroleum present in the formation. Injection of solvent is not on a continuous basis during the course of miscible displacement oil recovery process. Rather, a predetermined volume of solvent is injected into the formation, allowed in some instances to remain for a period of time sufficient to ensure that it has spread across the desired aerial extent of the formation, and thereafter gas is injected into the top of the formation and no solvent is injected. In actual field conditions, it might be preferred to inject solvents into the formation via both wells 2 and 3 in the attached FIG. 1, until the predetermined amount of solvent has been injected. Thereafter solvent injection would be discontinued in both wells, and dry gas would be injected into the formation via wells 2 and 3 simultaneously to serve as the drive fluid. In fact, some overlap of gas injection and solvent injection might be encountered, and so the conditions illustrated in FIG. 1 represents an intermediate time near the completion of solvent injection and the beginning of drive gas injection.

Figure 2:
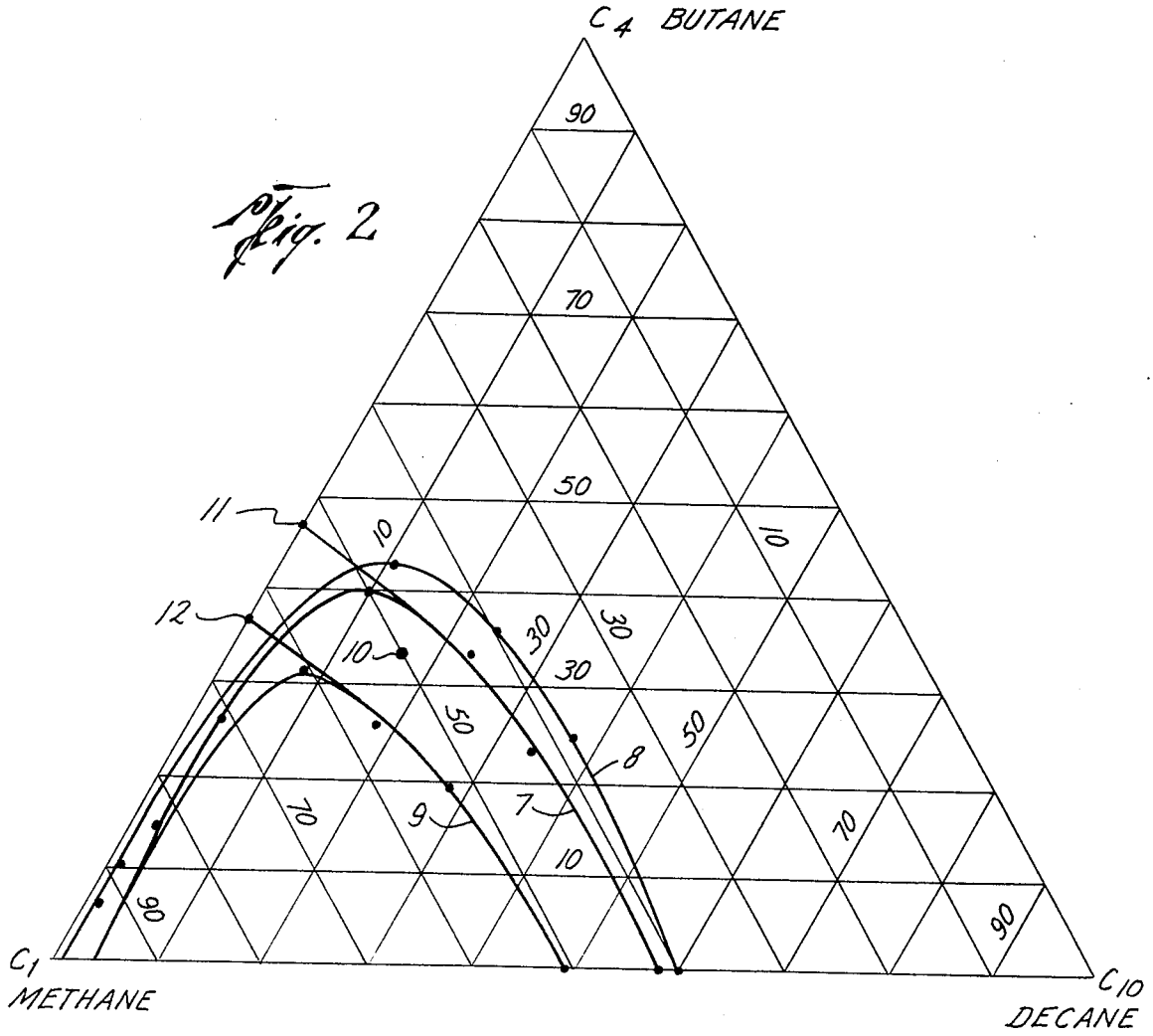
FIG. 2 illustrates a ternary diagram for a system comprising methane-butane-decane showing phase envelopes at 2000 pounds per square inch for three different temperatures, 280° F., 160° F., and 40° F.

The blanket of solvent 5 spreads across the formation and is displaced downward by drive fluid occupying the interval of formation 6 above the solvent blanket. Since hydrocarbon gases are commonly employed in the drive fluid, some mixture of hydrocarbon gas in the intermediate hydrocarbon fluid forming solvent bank 5 will occur. Ideally, conditions should be such that miscibility exists between all of the components injected into the formation and the fluids naturally present in the formation. A ternary diagram such as that shown in FIG. 2 is routinely employed by persons skilled in the related art of oil recovery for determining the conditions under which single phase liquid miscibility is obtained between the injected fluids and the hydrocarbons present in the fluid. A simplification is sometimes employed such as that illustrated in FIG. 2, in which the drive gas is shown as substantially pure methane, the solvent as substantially pure butane and decane is utilized to represent the naturally occurring hydrocarbons in the formation. In fact, natural gas is usually employed as the drive fluid and while it is predominantly methane, small concentrations of higher molecular weight paraffinic hydrocarbons are also usually present. Similarily, the solvent employed is generally a mixture of hydrocarbons in the range from $C_2$ to $C_5$, and in fact there is some advantage in employing such a mixture. Obviously, petroleum present in the formation will represent a large range of molecular species of varying molecular weight. It has been found, however, that the simplified ternary diagram can be used to accurately predict performance in the field of the more complicated fluids injected and present in the reservoirs.

Turning to FIG. 2, there can be seen the phase envelope of the ternary mixture of methane, butane and decane at 2000 pounds per square inch at three different temperatures. Curve 7 illustrates the phase envelope at approximately 160° F., which was the temperature of a particular reservoir being studied for miscible flooding conditions. Curve 8 illustrates how raising the temperature to 280° F. would shift the phase envelope. Curve 9 illustrates the change in the phase envelope resulting from reducing the temperature to about 40° F. The effectiveness of changing the temperature is illustrated by considering an equilibrium condition designated as point 10 on the diagram. This represents a mixture comprising approximately 50% methane, approximately 34% butane and about 17% decane. Point 10 represents a conditions which would exist in a reservoir into which fluids were injected sufficient to attain this relative proportion of the components described above. At the temperature of Curve 7, point 10 is in a two phase, gas and oil region. Under this condition, efficient miscible displacement could not be attained. By lowering the temperature sufficient to move the phase envelope from Curve 7 to Curve 9, point 10 is clearly made to fall in the single liquid phase region where efficient miscible displacement is obtained.

Another improvement in the operation is achieved by decreasing the temperature. By drawing tangents to the curve, it is possible to identify the minimal solvent component of a solvent gas mixture at which single liquid phase conditions can be attained after the mixture is injected into the reservoir. It can be seen that by reducing the temperature of the portion of the formation in which a miscible condition is to be attained, the amount of the intermediate hydrocarbon, e.g., the solvent in an oil recovery method and butane in a ternary diagram, is reduced from about 48% to about 38%, a significant reduction in the amount of solvent required to attain miscibility. This would cause a very significant reduction in the cost of operating a miscible displacement process in the field.

Reduction in temperature in the portion of the formation in which the condition of miscibility is sought to be achieved can be accomplished by injecting a fluid into that portion of the formation at a temperature substantially less than formation temperature. It is not necessary to inject sufficient cold fluid into the formation to cool substantially the entire formation from which recovery must ultimately be sought. Miscibility is a dynamic condition and the zone where the miscibility condition exists, moves downward through the formation during the course of conducting the miscible displacement oil recovery method. In the application illustrated in FIG. 1, the zone where miscibility should be achieved is in the region of the miscible blanket or layer of solvent illustrated in zone 5 of FIG. 1. If the solvent and the gas injected with the solvent are both chilled prior to injecting into the formation, the temperature of the zone in which the solvent contacts the formation is reduced and injection of cold gas maintains the temperature in the desired portion of the formation at a temperature substantially lower than that existing in the bottom portion of formation 1 during the course of the injection sequence, until the miscible blanket 5 had moved to a point near the bottom of formation 1.

In this particular application, it is strongly preferred that the temperature of any fluid injected into the formation be maintained at a level above the freezing point of water, in order to avoid freezing water present in the formation, which could cause localized loss of permeability in that zone of the formation which would interfer with efficient movement of solvent thereby. The fluid temperature should be in the range of from 35° F. to 100° F. and preferably from 40° F. to about 70° F.

Another preferred method for accomplishing temperature reduction in the portion of the formation where miscibility is sought to be achieved, comprises compressing the drive gas to a pressure substantially greater than would ordinarily be employed for gas injection, and cooling the high pressure gas, preferably by ambient air temperature cooled heat exchangers. The gas is then injected into the formation at relatively low temperature, i.e., substantially lower than that which exists after the gas compression stage. The perforations in the gas injection well 3 would then be made relatively small, so a substantial pressure drop exists across these perforations. The perforations should be chosen so the pressure drop across the perforations is at least 300 psi and preferably at least 700 psi. This ensures that substantially all of the gas expansion occurring during the injection phase occurs at perforations 13 of well 3. Accordingly, the drive gas will in this embodiment serve as a refrigerant as well as a drive gas, and the portion of the formation in the general vicinity of perforation 13 will be cooled significantly.

EXAMPLE

For the purpose of illustrating the amount of energy required to produce the degree of cooling required and the degree of improvement attained by the process of this invention, the following calculated example is offered.

For the purpose of simplicity, a small segment of the reservoir where miscible displacement is sought to be achieved according to the process of this invention, is examined. A reservoir having a porosity of 15% and an oil saturation of 80% is considered for the purpose of determining the amount of energy required to cool the portion of the reservoir containing one barrel of oil from 160° F. to 40° F. The rock volume in this instance is:

$$V = \frac{(1\ bbl\ \text{oil})\ (5.6)}{(1.5 \times 10^{-1})\ (8 \times 10^{-1})} = 46.7\ \text{ft}^3$$

The amount of energy required to cool this portion of the formation, including both the formation rock and the oil contained in the pore spaces thereof is calculated as follows:

$$H = (46.7)(36)(120) = 201{,}744\ \text{BTU}$$

The foregoing illustrates that it is necessary to expend 201,744 BTU's to produce sufficient cooling to reduce the temperature of a segment of reservoir containing one barrel of oil, together with the associated reservoir rock, from 160° F. to 40° F. This is a reasonable number, and it is substantially less than the amount of energy expended in some thermal oil recovery methods in connection with thermal recovery of viscous oil, wherein it is not unusual to expend over one million BTU's per barrel of oil produced. The improvement in the miscible process resulting from cooling the fluids to 40° has been discussed above.

The foregoing illustrates how a miscible displacement process is improved substantially by cooling one or more of the fluids being injected into the formation during the course of conducting the miscible process so as to reduce the temperature of the portion of the formation where miscibility is to be achieved, in order to educe the pressure required to achieve a condition of miscibility between the injected fluids and the petroleum naturally occurring in the formation, or to reduce the amount of solvent required to be injected to achieve miscibility, or both.

While my invention has been described in terms of a number of illustrative embodiments, it is not so limited since many variations thereof will be apparent to persons skilled in the art of oil recovery without departing from the true scope of my invention. It is my intention and desire that my invention be limited only by the limitations and restrictions appearing in the claims appended immediately hereinafter below.

I claim:

1. In a method of recovering petroleum from a subterranean, petroleum-containing, permeable formation, said formation being penetrated by at least one injection well and by at least one production well, comprising injecting a miscible fluid into the formation followed by injecting an inert drive fluid into the formation to displace the miscible fluid and petroleum through the formation to the production well, from which it is recovered to the surface of the earth, wherein the improvement comprises:

cooling the miscible fluid injected into the formation in order to reduce the pressure required to achieve a condition of miscibility within the formation.

2. A method as recited in claim 1 comprising cooling the drive fluid in addition to the miscible fluid.

3. A method as recited in claim 1, comprising cooling the fluid to a temperature below formation temperature and above the freezing point of water prior to injecting it into the formation.

4. A method as recited in claim 3 wherein the fluid is cooled to a temperature of from 35° F. to 100° F. prior to injecting it into the formation.

5. A method as recited in claim 3 wherein the fluid is cooled to a temperature of from 40° F. to 70° F. prior to injecting it into the formation.

6. In a method of recovering petroleum from a subterranean, petroleum-containing, permeable formation, said formation being penetrated by at least one injection well and by at least one production well, comprising injecting a miscible fluid into the formation followed by injecting an inert gaseous drive fluid into the formation to displace the miscible fluid and petroleum though the formation to the production well, from which it is recovered to the surface of the earth, wherein the improvement comprises:

providing the injection well with tubing having perforations of a predetermined size, compressing the inert drive gas to a predetermined pressure, cooling it, injecting it into an injection well and allowing the compressed cooled gas to expand through perforations in the injection well tubing, to produce an in situ cooling effect.

7. A method as recited in claim 6 wherein the size of the perforations is chosen to ensure that the pressure differential across the perforation is at least 700 pounds per square inch.

8. A method as recited in claim 6 wherein the size of the perforations is chosen to ensure that the pressure differential across the perforations is at least 300 pounds per square inch.

9. In a method of recovering petroleum from a subterranean, petroleum-containing permeable formation, said formation being penetrated by at least one injection well in fluid communication with the upper portion of the formation and by at least one producing well in fluid communication with the lower portion of the formation, comprising injecting a miscible fluid into the formation via the injection well followed by injecting an inert gaseous drive fluid into the formation to displace the miscible fluid and petroleum in a downward direction through the formation to the producing well, from which it is recovered to the surface of the earth, wherein the improvement comprises:

cooling at least one of the fluids injected into the formation in order to reduce the pressure required to achieve a condition of miscibility within the formation.

10. A method as recited in claim 9 comprising cooling the miscible fluid.

11. A method as recited in claim 9 comprising cooling the drive fluid.

12. A method as recited in claim 9 comprising cooling both the drive fluid and the miscible fluid.

13. A method as recited in claim 9 wherein the fluid is cooled to a temperature below formation temperature and above the freezing point of water prior to injecting it into the formation.

14. A method as recited in claim 9 comprising providing the injection well with tubing having perforations of a predetermined size compressing the inert gaseous drive fluid to a predetermined pressure, cooling it, injecting it into the injection well, and allowing the compressed gas to expand through perforations in the injection well tubing, to produce an in situ cooling effect.

15. A method as recited in claim 9 wherein the size of the perforations is chosen so as to ensure that the pressure differential across the perforations is at least 700 pounds per square inch.

16. A method as recited in claim 9, wherein the size of the perforations is chosen so as to ensure that the pressure differential across the perforations is at least 300 pounds per square inch.

* * * * *